US008375879B2

(12) United States Patent
Whitten et al.

(10) Patent No.: US 8,375,879 B2
(45) Date of Patent: Feb. 19, 2013

(54) PAYLOAD STOWAGE UNIT

(75) Inventors: Timothy James Whitten, Bristol (GB); Nicholas John Carter, Bristol (GB)

(73) Assignee: Babcock Integrated Technology Limited, Bristol (GB)

( * ) Notice: Subject to any disclaimer, the term of this patent is extended or adjusted under 35 U.S.C. 154(b) by 176 days.

(21) Appl. No.: 12/866,937

(22) PCT Filed: Feb. 6, 2009

(86) PCT No.: PCT/GB2009/000328

§ 371 (c)(1),
(2), (4) Date: Dec. 27, 2010

(87) PCT Pub. No.: WO2009/101387

PCT Pub. Date: Aug. 20, 2009

(65) Prior Publication Data

US 2011/0083600 A1 Apr. 14, 2011

(30) Foreign Application Priority Data

Feb. 11, 2008 (GB) ..... 0802506.6

(51) Int. Cl.
*B63G 8/00* (2006.01)

(52) U.S. Cl. ..... 114/321; 114/238

(58) Field of Classification Search ..... 114/238, 114/316, 318, 319, 321
See application file for complete search history.

(56) References Cited

U.S. PATENT DOCUMENTS

| | | | | |
|---|---|---|---|---|
| 1,097,625 | A * | 5/1914 | Gunn | 114/238 |
| 1,801,986 | A | 4/1931 | Spear | |
| 2,848,970 | A * | 8/1958 | Gunning | 114/319 |
| 3,379,163 | A * | 4/1968 | Wiethoff | 114/238 |
| 3,395,669 | A * | 8/1968 | Keenan | 114/238 |
| 5,388,545 | A | 2/1995 | Escarrat | |
| 5,448,962 | A * | 9/1995 | Moody | 114/238 |
| 5,675,117 | A | 10/1997 | Hillenbrand | |
| 5,834,674 | A * | 11/1998 | Rodriguez et al. | 114/238 |

FOREIGN PATENT DOCUMENTS

| | | |
|---|---|---|
| DE | 977 318 | 12/1965 |
| FR | 1 218 753 | 5/1960 |
| GB | 00606 | 6/1915 |
| GB | 121 476 | 2/1920 |

OTHER PUBLICATIONS

International Search Report for PCT/GB2009/000328.

Written Opinion of the International Searching Authority for PCT/GB2009/000328.

* cited by examiner

*Primary Examiner* — Lars A Olson

(74) *Attorney, Agent, or Firm* — Stites & Harbison PLLC; Marvin Petry

(57) ABSTRACT

A stowage unit for a payload such as a weapon, countermeasure or unmanned underwater vehicle (UUV), and a method for using the unit to deploy the payload are described. The unit comprises an inner tube for holding the payload, wherein the inner tube is mounted in an outer vessel and so defines a volume between the outer vessel and inner tube. The volume has a first sealing element, which can be used to open or seal the volume at one end, and a valve enabling fluid communication between the volume and inner tube. After deployment of the payload, a weight of fluid equivalent to the deployed payload can be allowed to enter the volume from the inner tube, thus enabling the weight of the unit to remain substantially unaltered from before deployment to after deployment.

17 Claims, 4 Drawing Sheets

PAYLOAD STOWAGE UNIT

BACKGROUND OF THE INVENTION

1. Field of the Invention

The present invention relates to an external stowage unit for a payload such as a weapon, countermeasure or unmanned underwater vehicle (UUV). It also relates to marine vessels incorporating such a stowage unit, and in particular, submarines incorporating such a stowage unit.

2. Summary of the Prior Art

Stowage units are known for storing weapons or countermeasures on marine vessels. Such units typically include an openable container for holding the weapon or countermeasure which, when closed, forms a 'dry volume' that protects the contents from the external environment. In some instances the container is mounted within a larger volume such that it can move within the larger volume. Such 'shock-mounting' shields the stowed weapon or countermeasure from impulsive accelerations. An embodiment of this concept is the 'tube within a tube' where a conventionally sized torpedo tube is shock-mounted within a larger tubular volume.

Deployment of the weapon or countermeasure can affect the buoyancy of the marine vessel incorporating the stowage unit. Prior to deployment the dry volume may be equilibrated with the ambient environment which, during submerged operation of the stowage unit, involves water displacing the gas occupying the dry volume. On release of the weapon or countermeasure, the overall mass of the stowage unit is reduced by an amount corresponding to the deployed weapon or countermeasure.

It is important that deployment of the payload does not adversely affect the buoyancy of the vessel. In vessels where the stowage unit is located internal to the waterproof hull, the changes in buoyancy caused by deployment can be compensated for by channelling the displaced gas into the watertight compartment and transferring a weight of water equivalent to the deployed payload from the external environment into the watertight compartment.

Internal placement of the stowage unit necessitates penetration of the watertight hull. External placement of the stowage unit may also require penetration of the watertight hull. The structural integrity requirements of the watertight hull often constrain the operation and positioning of weapon stowage units that penetrate it. This can lead to a sub optimal solution for both the vessel and the stowage unit. This is a particularly important consideration in the design of submarines, where the watertight hull (the 'pressure hull') must be able to resist a higher hydrostatic pressure than that experienced by surface vessels.

SUMMARY OF THE INVENTION

At its most general, the present invention proposes that a tube which stores a payload such as a weapon, countermeasure or unmanned underwater vehicle (UUV) is contained in an outer vessel, and has a valve to permit fluid (liquid such as water, or air or other gases) to pass between the inner tube and the space around it within the outer vessel. The ends of that space may then be sealable, to close it when appropriate. With such an arrangement, gas may be passed from the inner tube to the space before discharge of the payload without being vented to the environment. Venting to the environment is often not desired as it can cause the position of the submarine to become known. Similarly, when the payload is discharged water may be passed from the inner tube to the space in order to maintain the weight of the unit at about the same level before and after discharge.

Therefore, according to a first aspect of the present invention, there may be provided a payload stowage unit for a marine vessel, where the payload may, for example, be a weapon, countermeasure or unmanned underwater vehicle (UUV), the stowage unit having:

- an outer vessel;
- an inner tube for holding the payload, the inner tube being mounted inside the outer vessel to define a volume between the outer vessel and inner tube;
- a first sealing element positioned at a first end of the volume, the first sealing element having a closed configuration in which it seals the first end of the volume, and an open configuration in which the volume is unsealed; and
- a valve enabling fluid communication between the volume and the inner tube.

With this invention, fluids within the inner tube can be allowed to enter the volume between the inner tube and outer vessel, where they can be stored. Gas displaced from the inner tube can therefore be stored in that volume, as opposed to being released into the ambient environment. Likewise, a weight of fluid equivalent to the deployed payload can be allowed to enter the volume from the inner tube. This enables the weight of the unit to remain substantially unaltered from before deployment to after deployment.

The present invention also has the advantage that, in the open configuration, the sealing elements do not constrain the movement of the inner tube.

The inner tube may be circular or non-circular in cross-section. In preferred embodiments the inner tube is circular or substantially circular in cross-section.

In preferred embodiments, the outer vessel comprises a tube and the volume defined by the outer tube and inner tube is an annular volume.

Preferably, the inner tube is 'shock mounted' within the outer vessel so that it can move within the outer vessel. That is, the inner tube may be movable on its mountings within the outer vessel. This mounting arrangement shields the stowed payload from impulsive accelerations. The inner tube may be biased toward a central position within the outer vessel.

The marine vessel may be a surface vessel such a frigate, cruiser, destroyer, aircraft carrier or gunboat. Alternatively the vessel may be a submarine. The vessel may be 'double-hulled', with an inner, watertight hull and an outer casing. The external stowage units may be mounted in the cavity between the watertight hull and the outer casing.

Preferably, the stowage unit has a second sealing element positioned at a second end of the volume, the second sealing element having a closed configuration in which it seals the second end of the volume, and an open configuration in which the volume is unsealed. With such an arrangement the first and second sealing elements may be simultaneously deployed from the open configuration to the closed configuration.

The or each sealing element may be a sliding sleeve movable along the inner tube. In one arrangement, movement of the sleeve or sleeves along the inner tube moves the sealing element or elements between the open and closed configurations. The sleeve or sleeves may have flanges which can engage with the outer vessel to seal one or both ends of the volume. Preferably, the outer vessel may have first and/or second rims adapted to engage the first and/or second sealing elements, respectively. In preferred embodiments the sleeve or sleeves have flanges which can engage with the rim or rims of the outer vessel to seal one or both ends of the volume. The seal may be effected by a face sealed gasket or o-ring seal. In particular, the or each rim of the outer vessel may have an annular protrusion which can interact with a gasket mounted on the respective flange or flanges of the sleeve or sleeves to create a seal.

Other types of sealing elements are possible, such as expandable collars at the end or ends of the inner tube. This type of sealing element switches between open and closed configurations without moving along the inner tube.

The valve may be a flow controlling valve. Alternatively, the flow through the valve may be automatically regulated according to the buoyancy of the stowage unit. In a different arrangement, the valve is remotely regulated by an operator. In a further arrangement, the valve is programmed to allow a predetermined volume of fluid pass from the inner tube to the sealed annular volume.

In a second aspect, the present invention may provide a marine vessel including the payload stowage unit according to the first aspect. The marine vessel may be a surface vessel or a submarine vessel. The marine vessel may have an inner hull and an outer casing, and the stowage unit may be external to the inner hull. The stowage unit may also be internal to the outer casing.

The stowage unit may be connected to an externally mounted power supply and may also have an externally mounted launch control. In some embodiments, operation of the stowage unit is entirely self-contained and requires no physical communication with the pressure hull. In other embodiments the hull is penetrated to allow for the transmission of launch and/or control signals. The size of the hull penetrations may be greatly reduced by mounting the majority of the system components and/or the power supply externally.

In a third aspect, the present invention may provide a method of deploying a payload from the inner tube of a stowage unit according to the first aspect, the method including the steps of:

(i) arranging the first sealing element in the closed configuration;

(ii) flooding the inner tube with water;

(iii) displacing gas from the inner tube into the volume via the valve; and (iv) deploying the payload.

In this way, when the inner tube is flooded prior to deployment the displaced gas is released to the volume between the inner tube and outer vessel rather than the environment, to avoid adversely affecting the buoyancy of a marine vessel in which the stowage unit may be mounted.

The method may include the additional step of: (vi) displacing an amount of water substantially equivalent in weight to the weight in water of the deployed payload from the inner tube into the annular volume via the valve.

When the payload leaves the inner tube, the inner tube is automatically filled with a volume of water equivalent to the volume of the payload. If the payload is negatively buoyant (denser than water), which is likely, this will leave the system lighter than before firing. To redress the balance the system must take on extra water, in the annulus, equivalent to the difference between the weight of the payload and the weight of the water of the same volume. This is the 'weight in water' of the payload.

In this way, any effect on buoyancy caused by deployment of the payload can be further reduced.

BRIEF DESCRIPTION OF THE DRAWINGS

An embodiment of the present invention will now be described in detail, by way of example, with reference to the accompanying drawings, in which.

DETAILED DESCRIPTION

Figure 1:
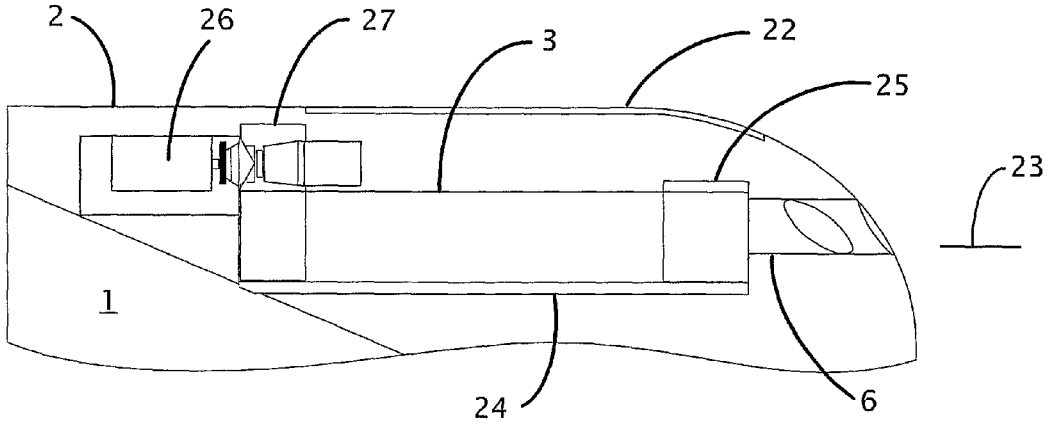
FIG. 1 shows the double-hulled bow portion of a submarine ready to receive an external stowage unit according to an embodiment of the present invention.

In an embodiment of the present invention the external stowage unit is installed between the pressure hull 1 and the outer casing 2 of a double-hulled submarine. The stowage unit is accessed via casing closure plate 22. The pressure hull 1 resists external hydrostatic pressure and creates a watertight compartment, whilst the outer casing 2 gives the submerged submarine a hydrodynamic shape. The estimated water line when the submarine is surfaced is indicated by reference numeral 23.

In the present embodiment the stowage unit is fastened within a coffer dam 3 in a forward-pointing position by means of fastening struts 4 that project from the outer tube 5 of the stowage unit. The coffer dam may be omitted in other embodiments. Deployment of the stowed payload is through a shutter 6 in the outer casing 2 of the submarine. Optionally, the submarine has no outer casing and the stowage unit is attached directly to the pressure hull. Other arrangements of positioning the stowage unit are also possible.

Figure 2:
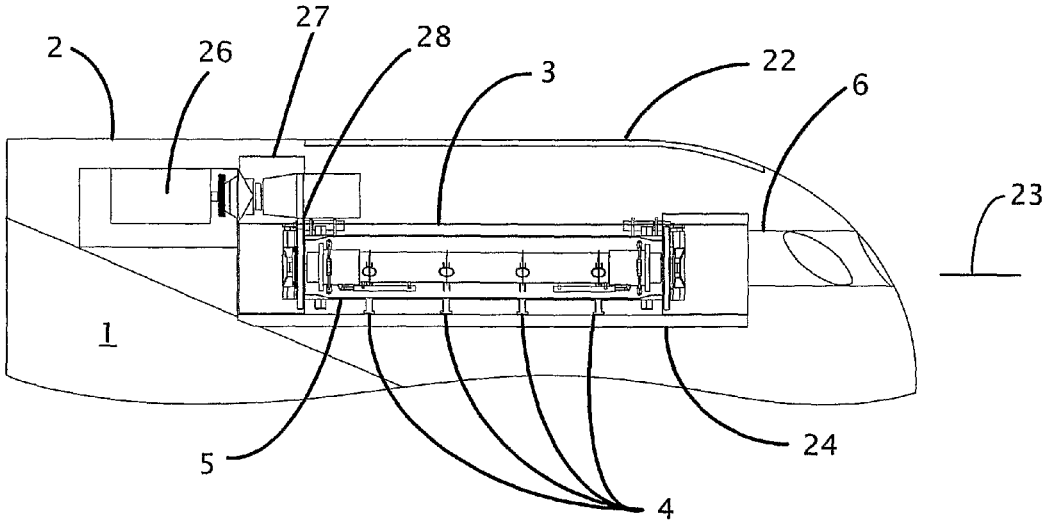
FIG. 2 shows the same double-hulled bow portion of a submarine with an external stowage unit according to an embodiment of the present invention installed.
Figure 3:
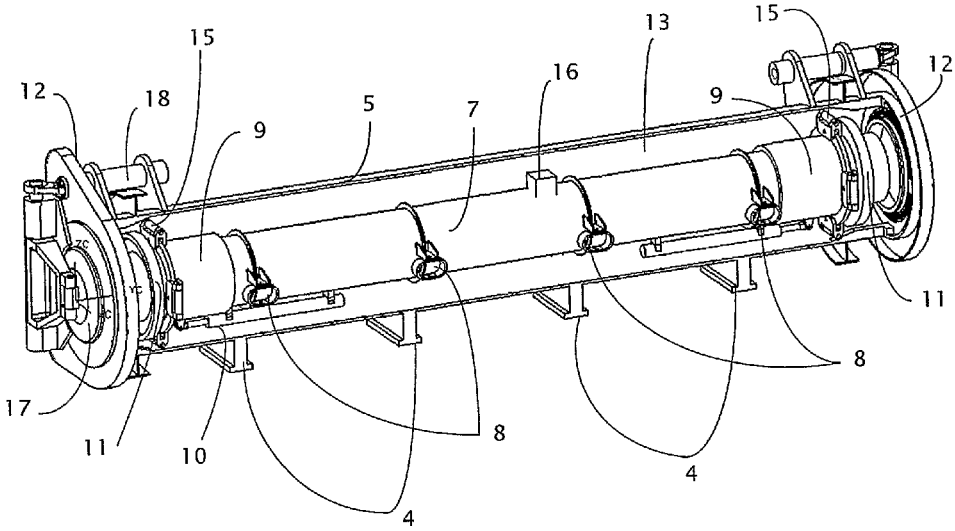
FIG. 3 shows a cutaway three dimensional representation of an external stowage unit according to an embodiment of the present invention.
Figure 4:
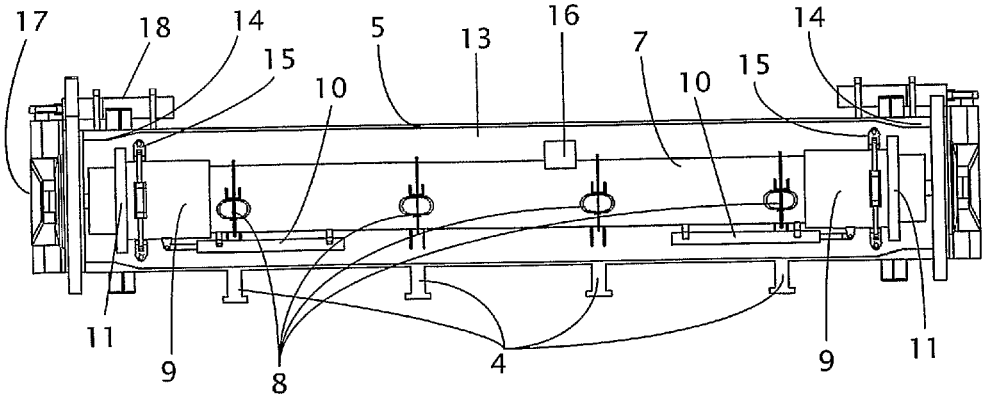
FIG. 4 shows a side view of the stowage unit shown in FIG. 3 represented as a line drawing.
Figure 5:
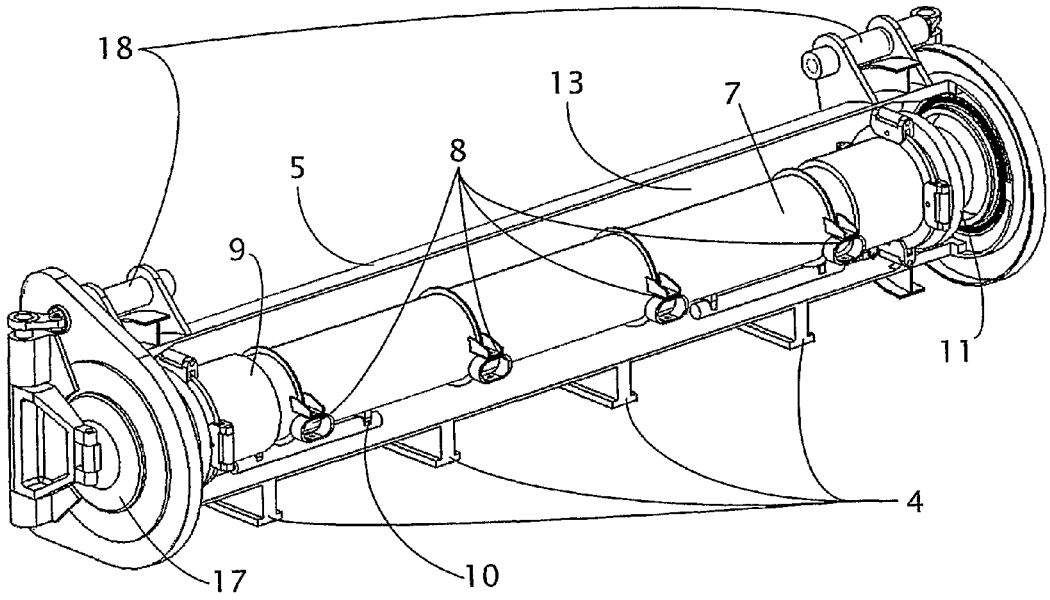
FIG. 5 shows a cutaway isometric view of a stowage unit according to an embodiment of the present invention in a stowage position.
Figure 6:
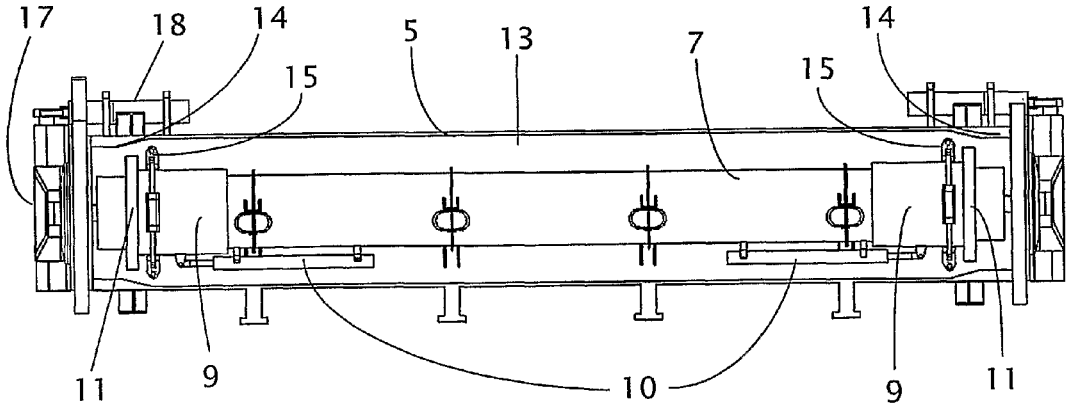
FIG. 6 shows a side view of the stowage unit shown in FIG. 5.
Figure 7:
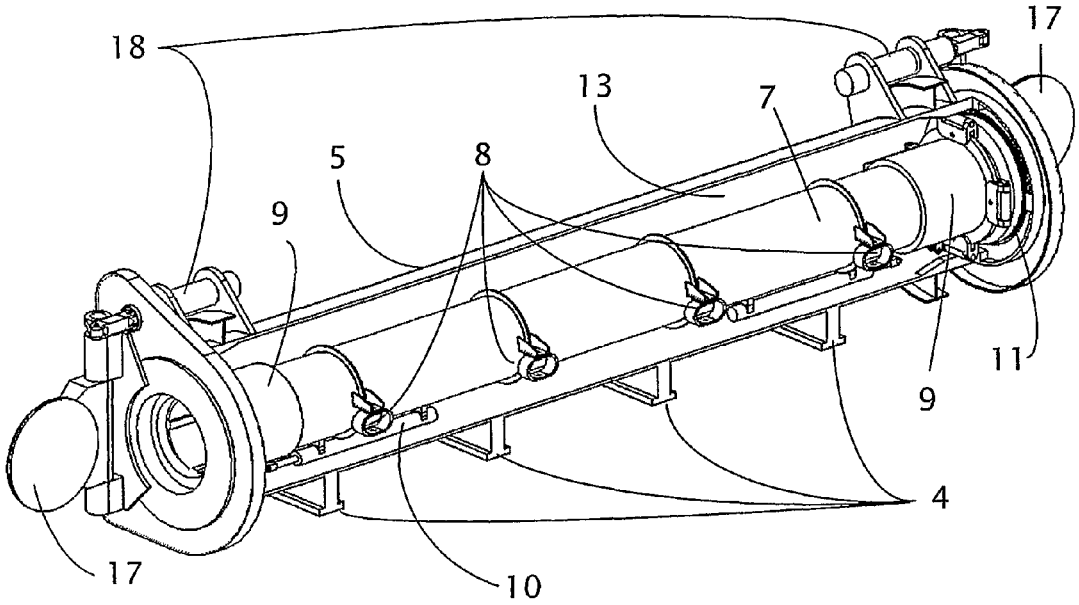
FIG. 7 shows a cutaway isometric view of a stowage unit according to the present invention in a discharge position.

In the embodiment illustrated in FIGS. 1 and 2 the coffer dam 3 is supported by support structure 24 and is aligned with the shutter 6 by the intermediate guide tube 25. Ancillary equipment includes the electric discharge unit 26 and water transfer tank 27, the latter being provided with an interface to the stowage unit by the tube aft frame 28. The water transfer tank 27 is used where the payload is discharged by the action of water pumped in behind it. A pump (not shown) transfers water from the water transfer tank 27 to the inner tube 7.

In one embodiment, the stowage unit resembles a 'tube within a tube'. Inner tube 7 is mounted within an outer tube 5 by a series of connections 8 positioned along the tubes' long axis. Preferably, the connections are 'shock mounts' that permit the inner tube 7 to move within the outer tube 5. The connections may also bias the inner tube 7 to a central position within the outer tube 5. The mounts may be aligned along the same axis, but other arrangements are also possible.

Fitted over both ends of inner tube 7 are sliding sleeves 9. Attached to the sleeves 9 are sleeve pistons 10, which are themselves anchored to inner tube 7. In this arrangement, the extension of the sleeve pistons 10 causes the sleeves 9 to move toward the ends of inner tube 7. Other mechanisms for driving the movement of sleeves 9 are possible e.g. a system of meshed sprockets or screw thread.

Figure 8:
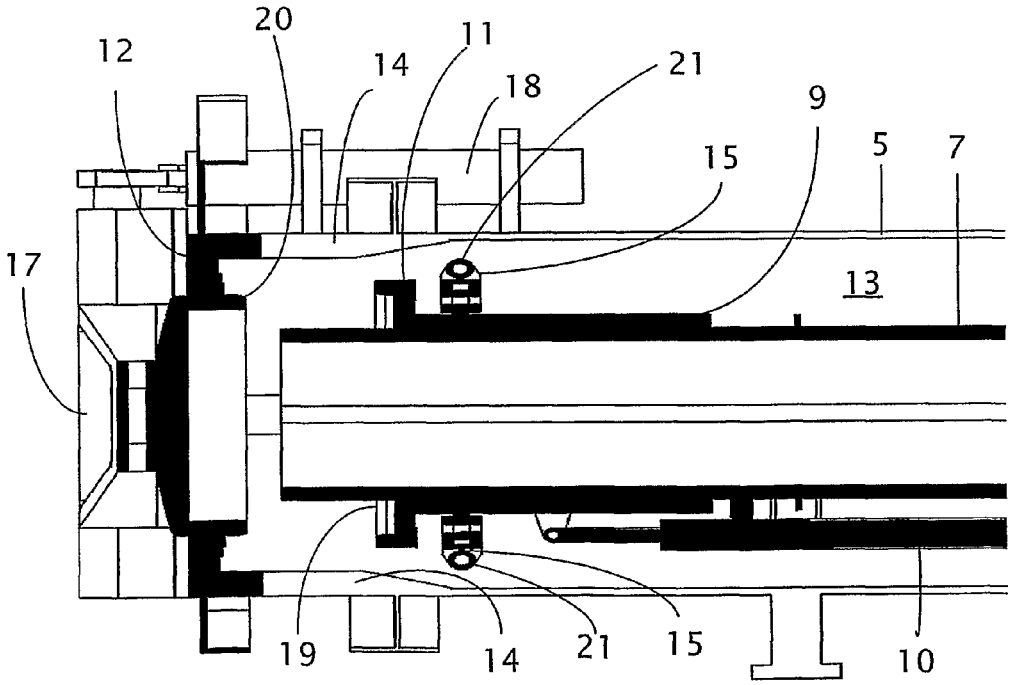
FIG. 8 shows a detail view of a cross-sectional view of a stowage unit according to an embodiment of the present invention.

Each of the sleeves 9 has a flange 11 which is adapted to engage with the rims 12 at each end of outer tube 5. As can be seen from FIG. 8, the rims 12 are each provided with an annular projection 20 which engages with a gasket 19 mounted on the flange 11 of the sleeve 9 when the sleeve is extended. By this arrangement, the rims 12 conform with flanges 11, the urging of the flanges 11 against the rims 12 by the extension of sleeve pistons 10 sealing the ends of the annular volume 13 defined by the two tubes.

The abutment of the flanges 11 and the rims 12 provides a robust seal at the each end of the annular volume 13. This is especially advantageous when the unit is operating under conditions of high hydrostatic pressure. Weak sealing may allow leakage of fluids into or out of the annular volume under high pressure conditions. However, while advantageous, the rims 12 and flanges 11 are not essential elements. For example, in an alternative embodiment the outer tube 5 may have a tapered internal diameter arranged such that the urging of the sleeves 9 by the pistons 10 causes the sleeves 9 to tightly abut the interior of the outer tube 5 and seal the annular volume 13.

Toward each end of the outer tube 5 the internal diameter narrows to form a guide ledge 14. The sleeves 9 also have guide collars 15 that engage the guide ledge 14 as the sleeves 9 move toward the rims 12. The guide collars 15 are each provided with a roller bearing 21 which provides a rolling contact between the guide ledges 14 and the guide collars 15. The contact between the guide ledges 14 and collars 15 ensures that the flanges 11 and rims 12 are positioned correctly for sealing to be effective. That is, the sleeves 9 are guided, via collars 15, by the ramped surfaces of guide ledges 14 so that each sleeve 9 is axially aligned with outer tube 5. As a consequence, inner tube 7 is axially aligned with outer tube 5. This is illustrated particularly well in FIG. 8.

Attached to the inner tube 7 is a flow controlling valve 16 (not shown in FIGS. 5-8). The valve 16 allows the controlled passage of fluid between the inner tube 7 and the annular volume 13. Valve 16 may be located at any position along the boundary of the inner tube 7 and the annular volume 13. However, the presence of the sleeves 9 towards the end of the inner tube 7 means the valve 6 is preferably located toward the middle of the inner tube 7.

The ends of outer tube 5 are sealed by end caps 17. End caps 17 abut the exterior of rims 12 and seal the outer tube 5. Attached to end caps 17 are cap pistons 18, which are themselves anchored to outer tube 5. In this arrangement, the extension of cap pistons 18 causes the end caps 17 to open outer tube 5 to the external environment. Other mechanisms for driving the movement of end caps 17 are possible e.g. a system of meshed sprockets or screw thread. Optionally, the outer tube 5 may only have a single end cap 17 situated on the end of the outer tube facing the shutter 6. In embodiments with a single end cap 17, discharging a self-propelled weapon, the inner diameter of the inner tube 7 must be sufficiently greater than the diameter of the payload to enable sufficient quantities of water to be sucked into the inner tube via the one opening to replace the space vacated by the payload when it is discharged. If there is insufficient clearance between the payload and inner tube 7 and only one end cap 17 then the discharge of the payload will be restricted. Alternatively, this issue is avoided with certain positive discharge methods, such as discharge using high pressure air or a gas generator.

A deployment sequence may begin with the end caps 17 being shut, the sliding sleeves 9 retracted, and the inner tube 7 and the annular volume 13 drained. In this configuration the inner tube 7 is insulated from impulsive accelerations affecting the outer tube 5 by means of the shock mountings 8.

On deployment, the sleeve pistons 10 extend, moving the sliding sleeves 9 toward the end of the inner tube 7. As the sleeves 9 move, the guide collars 15 on the sleeves engage with the guide ledges 14 on the outer tube to correctly position the sleeves 9. The continued extension of the sleeve pistons 10 urges the flanges 11 onto the rims 12 at the ends of the outer tube 5, sealing the annular volume 13.

Once the annular volume 13 is sealed, the cap pistons 18 operate, unsealing the end caps 17 and flooding the inner tube 7. In some embodiments the inner tube 7 is first flooded via valves in the end caps 17 before the end caps are opened, to reduce the risk of air in the inner tube 7 escaping into the surrounding environment and to equalise the pressure either side of the cap which allows the cap to be opened. The gas displaced from the inner tube 7 as it floods is allowed to enter the annular volume 13 through the valve 16. Once the inner tube 7 is flooded and the end caps 17 opened, the shutter 6 is opened. The payload can now be deployed.

After deployment, a volume of water equivalent in weight to the weight in water of the deployed payload is allowed to enter the annular volume 13 from the flooded inner tube 7 via the valve 16. This ensures that the total weight of the stowage unit does not substantially change from before deployment to after deployment.

The invention claimed is:

1. A payload stowage unit for a marine vessel, the stowage unit having an outer vessel and an inner tube for holding the payload, the inner tube being mounted inside the outer vessel to define a volume between the outer vessel and inner tube;

the unit having a valve enabling fluid communication between the volume and the inner tube, and a first sealing element positioned at a first end of the volume, the first sealing element having a closed configuration in which it seals the first end of the volume, and an open configuration in which the volume is unsealed, and wherein the sealing element comprises a sliding sleeve movable along the inner tube, wherein movement of the sleeve moves the sealing element between the open and closed configurations.

2. The payload stowage unit according to claim 1, wherein the stowage unit has a second sealing element positioned at a second end of the volume, the second sealing element having a closed configuration in which it seals the second end of the volume, and an open configuration in which the volume is unsealed.

3. The payload storage unit according to claim 2, wherein each sealing element comprises a sliding sleeve movable along the inner tube, wherein movement of each sleeve moves the sealing element between the open and closed configurations.

4. The payload storage unit according to claim 2, wherein each sleeve has a flange and the outer vessel has a rim that engages with the flange to seal the end of the volume.

5. The payload storage unit according to claim 2, wherein each sealing element comprises an expandable collar at the end of the inner tube.

6. The payload stowage unit according to claim 1, wherein the sleeve has a flange, and the outer vessel has a rim that engages with the flange to seal the end of the volume.

7. The payload stowage unit according to claim 1, wherein the sealing element comprises an expandable collar at the end of the inner tube.

8. The payload stowage unit according to claim 1, wherein the valve is a flow controlling valve.

9. The payload stowage unit according to claim 1, wherein the inner tube is circular or substantially circular in cross section.

10. The payload stowage unit according to claim 9, wherein the outer vessel comprises a tube and the volume defined by the outer tube and inner tube is an annular volume.

11. The payload stowage unit according to claim 1, wherein the inner tube is movable on mountings within the outer vessel.

12. A marine vessel including the payload stowage unit according to claim 1.

13. The marine vessel according to claim 12, wherein the marine vessel has an inner hull and an outer casing, and the stowage unit is positioned external to the inner hull.

14. A method of deploying a payload from the inner tube of a stowage unit, the stowage unit having an outer vessel and an inner tube for holding the payload, the inner tube being mounted inside the outer vessel to define a volume between the outer vessel and inner tube, the stowage unit also having a first sealing element at one end of this volume, the sealing element comprising a sliding sleeve movable along the inner tube, and a valve enabling fluid communication between the volume and the inner tube, the method comprising the steps of:

arranging the first sealing element in the closed configuration;

moving the sliding sleeve along the inner tube to open the sealing element to flood the inner tube with water;

displacing gas from the inner tube into the volume via the valve; and deploying the payload.

15. The method according to claim 14 wherein a volume of water substantially equivalent in weight to the weight in water of the deployed payload is displaced from the inner tube into the volume via the valve.

16. A payload stowage unit for a marine vessel, the stowage unit having an outer vessel and an inner tube for holding the payload, the inner tube being mounted inside the outer vessel to define a volume between the outer vessel and inner tube;

the unit having a valve enabling fluid communication between the volume and the inner tube, and a first sealing element positioned at a first end of the volume, the first sealing element having a closed configuration in which it seals the first end of the volume, and an open configuration in which the volume is unsealed, and wherein the sealing element comprises an expandable collar at the end of the inner tube.

17. A payload stowage unit for a marine vessel, the stowage unit having an outer vessel and an inner tube for holding the payload, the inner tube being mounted inside the outer vessel to define a volume between the outer vessel and inner tube;

the unit having a valve enabling fluid communication between the volume and, the inner tube, and a first sealing element positioned at a first end of the volume, the first sealing element having a closed configuration in which it seals the first end of the volume, and an open configuration in which the volume is unsealed, and wherein the inner tube is movable on mountings within the outer vessel.

* * * * *